US005292378A

United States Patent [19]

Ouyang et al.

[11] Patent Number: 5,292,378

[45] Date of Patent: Mar. 8, 1994

[54] VISIBLE DRIED-IN-PLACE NON-CHROME TREATMENT FOR ALUMINUM

[75] Inventors: Jiangbo Ouyang, Bensalem; Bruce V. Haberle, Fogelsville; Philip D. Deck, Ardsley; William L. Harpel, Langhorne, all of Pa.

[73] Assignee: Betz Laboratories, Inc., Trevose, Pa.

[21] Appl. No.: 38,592

[22] Filed: Mar. 26, 1993

[51] Int. Cl.[5] ..... C23C 22/06

[52] U.S. Cl. ..... 148/241; 148/244

[58] Field of Search ..... 148/241, 244

[56] References Cited

U.S. PATENT DOCUMENTS 3,114,660 12/1963 Cochran ..... 148/244

3,326,728 6/1967 Robinson ..... 148/244

*Primary Examiner*—Sam Silverberg

*Attorney, Agent, or Firm*—Alexander D. Ricci; Steven D. Boyd

[57] ABSTRACT

A method of providing color to a dried-in-place, non-chromate conversion coating is provided. The addition of a phthalo green pigment and optionally a nonionic surfactant to an aqueous, dried-in-place conversion coating treatment solution provides for a colored conversion coating without adversely effecting the corrosion resistance or adhesion properties of the conversion coating.

4 Claims, No Drawings

VISIBLE DRIED-IN-PLACE NON-CHROME TREATMENT FOR ALUMINUM

FIELD OF THE INVENTION

The present invention relates generally to non-chromate coatings for metals. More particularly, the present invention relates to a visible, siccative, non-chromate coating for aluminum and aluminum alloys. The visible coating of the present invention improves the corrosion resistance and adhesion of paint to the metal surface. The present invention provides a visible dried-in-place coating which is particularly effective at treating aluminum coil and formed aluminum.

BACKGROUND OF THE INVENTION

The purposes of the formation of a chromate conversion coating on the surface of aluminum are to provide corrosion resistance, improve adhesion of coatings and for aesthetic reasons. The conversion coating improves the adhesion of coating layers such as paints, inks, lacquers and plastic coatings. A chromate conversion coating is typically provided by contacting aluminum with an aqueous composition containing hexavalent or trivalent chromium ions, phosphate ions and fluoride ions. Typical chromium or chromate conversion coatings exhibit a visible coloration ranging from gold to brown.

Growing concerns exist regarding the pollution effects chromate and phosphate discharged into rivers and water ways by such processes. Because of high solubility and the strongly oxidizing character of hexavalent chromium ions, conventional chromate conversion coating processes, require extensive waste treatment procedures to control their discharge.

Attempts have been made to produce chromate free conversion coatings for aluminum. Chromate free pretreatment coatings based upon complex fluoacids and polyacrylic acids are known in the art. U.S. Pat. No. 4,191,596 which issued to Dollman et al., discloses a composition for coating aluminum which comprises a polyacrylic acid and $H_2ZrF_6$, $H_2TiF_6$ or $H_2SiF_6$. U.S. Pat. No. 4,921,552 which issued to Sander et al. discloses a nonchromate coating for aluminum which is dried in place which forms a coating having a weight from about 6 to 25 milligrams per square foot. The aqueous coating composition consists essentially of from more than 8 grams per liter $H_2ZrF_6$, more than 10 grams per liter of water soluble acrylic acid and homopolymers thereof and more than 0.17 grams per liter hydrofluoric acid.

U.S. Pat. No. 4,136,073 which issued to Muro et al., discloses a composition and process for the pretreatment of aluminum surfaces using an aqueous acidic bath containing a stable organic film forming polymer and a soluble titanium compound. U.S. Pat. No. 5,158,622 which issued to Reichgott et al., discloses a dried-in-place conversion coating for metal surfaces such as aluminum and aluminum alloys which employs an aqueous solution of a water soluble maleic or acrylic acid/allyl ether copolymer alone or with an acid.

Most non-chromate based pretreatments generate transparent coatings on metal surfaces. In the use of such pretreatments, the lack of a visible effect such as the color change common in chromate pretreatments makes it virtually impossible to visually verify the presence of a conversion coating. With the prior art chromate pretreatments, it was possible to not only quickly verify visually the presence of the conversion coating, but to also estimate the coating weight by the intensity of the color.

In the treatment of a fast moving coil of metal, visual verification can be very important. With a clear coating, the line must be stopped and a section of metal cut out for testing just to verify the existence of the conversion coating. With the present invention, the color change provides a quick visual verification of the presence of the conversion coating. Prior to the present invention, no methods existed to effectively impart color to a dried-in-place non-chromate conversion coating without anodizing the metal surface.

SUMMARY OF THE INVENTION

The present invention provides a method of imparting color to a dried-in-place non chromate based conversion coating. The method of the present invention involves the addition of a color imparting agent to a conventional dried-in-place non-chromate based conversion coating. The color imparting agent of the present invention does not adversely effect the corrosion resistance or adhesion properties of the conversion coating. Further, the coloration provided, while visible, is not so strong as to "bleed through" subsequently applied coating such as paints or lacquers. The method of the present invention imparts color to an unanodized aluminum or aluminum alloy surface while maintaining the adhesion and corrosion resistance of the conversion coating being applied. The method of the present invention involves the addition of a phthalo green pigment to a dried-in-place conversion coating treatment.

As used herein, the term aluminum refers to aluminum as well as alloys of aluminum. In addition, it is believed that the method of the present invention would be similarly effective in the treatment of Galvalume. Galvalume is a registered trademark of Bethlehem Steel Corporation for a zinc-aluminum galvanized steel.

DESCRIPTION OF THE PREFERRED EMBODIMENTS

The present inventors have discovered that color can be imparted to a dried-in-place non chromate conversion coating for aluminum without anodizing. The color is provided by adding a phthalo green pigment to a dried-in-place treatment solution and mixing in order to form a colored pretreatment solution. When applied to aluminum or aluminum alloy surfaces and allowed to dry in place, the colored pretreatment solution of the present invention provides a color to the conversion coating. The addition of a phthalo green pigment has been found to impart a visible color to the conversion coating without adversely affecting the adhesion properties or corrosion resistance provided by the conversion coating.

The color imparting agent added to the conversion coating treatment is a phthalo green. Phthalo green is a chlorinated copper phthalocyanine or Pigment Green 7. The present inventors found that phthalo green would impart a uniform green color to a dried-in-place conversion coating. The green color was provided without any adverse effects on the adhesion properties or corrosion resistance of the conversion coating. This feature of the phthalo green was unexpected in that many other pigments, including other phthalocyanine pigments were tested and found to be detrimental to either the adhesion properties or corrosion resistance of the conversion coating.

The phthalo green employed in accordance with the present invention is typically added to a dried-in-place conversion coating treatment solution in concentrations of from about 0.1 to 0.5% by weight. Depending upon the specific dried-in-place pretreatment solution being employed, there may be upper limits to the concentration of phthalo green which may be used. Such upper limits would be determined by a finding of detrimental effects on the paint adhesion and corrosion resistance as determined by conventional test procedures. Typically, the application of a pigmented dried-in-place conversion coating takes place at temperatures ranging from ambient i.e., 21° to 30° C.

The present inventors found that the addition of a nonionic surfactant in combination with the phthalo green pigment provided for a more uniform coloring. Also, the addition of a nonionic surfactant was found to improve the adhesion properties and corrosion resistance of the resulting pigmented dried-in-place conversion coating. Nonionic surfactants found to be effective included Triton X-100 available from Union Carbide and Surfonic N-95 available from Jefferson Chemical Company. It is believed that other nonionic surfactants having similar structures and physical properties would also be effective.

The present invention will now be further described with reference to a number of specific examples which are to be regarded solely as illustrative and not as restricting the scope of the present invention.

In these examples, the effects of the pigment on adhesion properties and corrosion resistance were evaluated with a variety of tests familiar to those skilled in the art. These tests included: "T-bend"; the tendency for paint to disadhere from a 180° bend in the metal (OT=perfect); "wedge bend": the amount of paint (in millimeters) lost from the surface above a minimum radius of curvature of a bend in the metal. The bend is formed by first turning the painted metal through a radius about 0.5 centimeters and then flattening an end of the bend to a zero radius; "cross-hatch/reverse impact": the tendency of paint to disadhere from areas between closely spaced lines through the paint, scribed prior to reverse impact, the test may be done dry or following boiling water treatment (10=a perfect rating); "acidic acid salts spray": per ASTM-B-287 (10=a perfect rating).

In the following examples, the dried-in-place conversion coating treatment solution employed was a water soluble acrylic acid/polyethylene glycol allyl ether copolymer as described in U.S. Pat. No. 5,158,622. This treatment solution as described in the patent provides a colorless conversion coating on the surfaces of aluminum or aluminum alloys. The treatment solution is available as Permatreat 1011 from Betz Laboratories, Inc., of Trevose, Pa.

While this treatment solution is typically dried in place, treated surfaces may be rinsed.

Numerous coloring agents in addition to the phthalo green of the present invention were tested in combination with the Permatreat 1011. Problems such as no obvious coloring effect, non-uniform coloring effect and performance deterioration were found in all but the present invention.

EXAMPLE 1

Aluminum test panels (3105 alloy) were cleaned by spraying with a commercial aqueous alkaline cleaner, rinsed with tap water, passed through squeegee rolls and treated by applying a solution of 15% Permatreat 1011. The solution was applied to test panels which were spun to produce a thin film and then dried in a stream of warm air.

The addition of 1 gram per liter of Rhodamine B, an intensely colored red dye, was added to the treatment solution. The resultant conversion coating exhibited an intense color. However, the coloring was speckled and areas of dense spots were noted. Also, the color "bled through" subsequently applied paint as well as deteriorated the paint adhesion.

The addition of Tannin to the treatment solution provided a gold coating, however the properties of the conversion coating deteriorated. Salicyclic acid/ferric sulfate added to the treatment solution provided a colored coating, but the coating was loose and powdery. The addition of ferrous sulfate to the treatment solution provided little color. Wool Violet Dye added to the treatment solution imparted variable color to the treated aluminum. The addition of copper, manganese and silver provided for a colored coating but the properties of the conversion coating deteriorated. When Alphazurinc Blue was added to the treatment solution, color in the conversion coating developed several days after application to the aluminum.

EXAMPLE 2

Aluminum test panels (3105 alloy) from a coil coater were treated by cleaning with a commercial alkaline cleaner, rinsed with tap water, and treated by applying an aqueous treatment solution of 15% Permatreat 1011, 1.0% Triton X-100 nonionic surfactant and 0.3% phthalo green (Tint-Ayd WR-2744 phthalo green available from Daniel Products Company, Jersey City, N.J.) in a laboratory spin coater (Treatment A). After spinning to a thin film, the treatment solution was dried-in-place with a stream of warm air. A control treatment (Treatment B) of 15% Permatreat 1011 was also applied which provided a clear coating. The phthalo green treatment solution exhibited an easily identified uniform green color. Three commercial paint systems were applied by drawn down rod and cured in accordance with the manufacturers specifications. Table 2 summarizes the results.

TABLE 2

| ID | PAINT TYPE | WEDGE BEND | T-BEND | XH/RI | XH/RI/BW | AASS(500 HRS) Scribe | AASS(500 HRS) Field |
|---|---|---|---|---|---|---|---|
| A | Epoxy/ | 34 | 2T | 8 | 8 | 7 | 10 |
| | Fluorocarbon | 31 | 2T | 10 | 10 | 9 | 10 |
| A | Acrylic | 42 | 4T+ | 10 | 2 | 7 | 10 |
| B | | 53 | 4T+ | 10 | 4 | 7 | 10 |
| A | Polyester | 0 | 2T | 10 | 2 | 7 | 10 |
| B | | 0 | 2T | 10 | 8 | 8 | 10 |

12 in/lb force was used in reverse impact, and panel was boiled for 15 minutes in XH/RI/BW test.

EXAMPLE 3

Aluminum coil (3105 alloy ) was treated in a pilot coil coating line under conditions similar to an industrial coil coating line. The process sequence was: (a) clean with a commercial alkaline cleaner (Betz Kleen$^R$ 4010) at 135° F. for 12 seconds; (b) rinse with tap water; (c) treat with a treatment solution either (A) 15% Permatreat 1011 as a control or (B) a 15% Permatreat 1011 plus 0.275% Tint-Ayd WR2744 and 0.2% Triton X-100 nonionic surfactant; (d) dry in an IR oven. The colored treatment yielded a very uniform and intense color on the moving aluminum coil. The color allowed for visual verification of the conversion coating while the coating line was in operation. After treatment, the coil was cut into test panel and painted with 3 commercial paint systems in accordance with the manufacturers specifications. Table 3 summarizes the results of testing.

TABLE 3

| ID | PAINT TYPE | WEDGE BEND | T-BEND | XH/RI | XH/RI/BW | AASS(500 HRS) Scribe | AASS(500 HRS) Field |
|---|---|---|---|---|---|---|---|
| A | Epoxy/ | 24 | 3T | 10 | 10 | 9.0 | 10 |
| B | Fluorocarbon | 24 | 4T | 10 | 10 | 9.0 | 10 |
| A | Acrylic | 51 | 4T+ | 10 | 10 | 7.5 | 9 |
| B | | 54 | 4T+ | 10 | 10 | 7.5 | 9 |
| A | Polyester | 17 | 2T | 10 | 10 | 7.5 | 10 |
| B | | 13 | 2T | 10 | 10 | 8.0 | 10 |

EXAMPLE 4

In order to simulate a working treatment solution bath, an aqueous treatment solution of 15% Permatreat 1011 with 0.2% Triton X-100 nonanionic surfactant and 0.2% Tint-Ayd WR2744 was loaded with increasing concentrations of aluminum. The combinations were used to treat aluminum test panels (3003 alloy) which had been cleaned with a commercial alkaline cleaner and rinsed. The treatment solutions were spin applied and dried-in-place as described above. Testing after application of three commercial paint systems applied in accordance with the manufacturer's specification is summarized in Table 4.

TABLE 4

| Al LOADING (PPM) | OVERALL PHYSICAL[a] | Acetic Acid Salt Spray (500 Hrs.) EPOXY FLUOROCARBON Scribe | EPOXY FLUOROCARBON Field | ACRYLIC Scribe | ACRYLIC Field | POLYESTER Scribe | POLYESTER Field |
|---|---|---|---|---|---|---|---|
| CONTROL | 4.9 | 7.0 | 6 | 7 | 9 | 7.0 | 10 |
| 12 | 5.8 | 9.0 | 10 | 8 | 9 | 9.0 | 10 |
| 199 | 5.7 | 9.5 | 10 | 8 | 9 | 9.0 | 10 |
| 347 | 6.8 | 9.5 | 10 | 7 | 9 | 9.0 | 10 |
| 409 | 6.2 | 9.5 | 10 | 8 | 9 | 9.5 | 10 |
| 513 | 4.8 | 9.5 | 10 | 7 | 8 | 9.0 | 10 |
| 591 | 4.6 | 9.5 | 10 | 8 | 8 | 9.0 | 10 |

[a]Overall physical evaluation included wedge bend, T-bend, and cross hatch/reverse impact/boiling water for 3 paint systems.

EXAMPLE 5

Testing was undertaken to determine the effects of nonionic surfactants on the phthalo green colored conversion coatings of the present invention.

In a first test, Alcan 3105 aluminum test panels were treated as described above with 15% Permatreat 1011 (treatment A), 15% Permatreat 1011 plus 0.275% phthalo green (treatment B) and 15% Permatreat 1011, 0.3% phthalo green and 1.0% Triton X-100 (treatment C). Table 5 summarizes the results of performance testing for 3 types of paints applied in accordance with the manufacturer's recommendations.

TABLE 5

| ID | PAINT ID[b] | WEDGE BEND | T-BEND | XH/RI | XH/RI/BW | AASS (500 HR) SCRIBE | AASS (500 HR) FIELD |
|---|---|---|---|---|---|---|---|
| A | 1 | 34 | 2T | 4B | 4B | 7 | 10 |
| B | 1 | 34 | 3T | 5B | 1B | 6.5 | 10 |
| C | 1 | 31 | 2T | 5B | 5B | 9 | 10 |
| A | 2 | 42 | 4T+ | 5B | 1B | 7 | 10 |
| B | 2 | 44 | 4T+ | 5B | 1B | 7 | 10 |
| C | 2 | 53 | 4T+ | 5B | 2B | 7 | 10 |
| A | 3 | 0 | 2T | 5B | 1B | 7 | 10 |
| B | 3 | 2 | 2T | 5B | 1B | 7 | 10 |
| C | 3 | 0 | 2T | 5B | 4B | 8 | 10 |

[b]Paint 1: PPG epoxy primer/PPG florocarbon top coat
Paint 2: PPG acrylic paint
Paint 3: Lilly polyester paint In a second test, a different nonionic surfactant; Surfonic N-95 was tested as described above. The treatment was as follows:

(1) 15% Permatreat 1011: (2) 0.2% phthalo green and 15% Permatreat 1011: (3) 15% Permatreat 1011, 0.2% phthalo green, and 0.2% surfonic N-95: (4) 15% Permatreat 1011, 0.2% phthalo green and 0.5% Surfonic N-95. The paint was Lilly polyester Flexar enamel applied in accordance with the manufacturer's specifications. Table 6 summarizes the results of adhesion testing.

TABLE 6

| TREATMENT | T-BEND | XH/RI | AASS (500 hr) SCRIBE | AASS (500 hr) FIELD |
|---|---|---|---|---|
| 1 | 2T | 5B | 7 | 10 |
| 2 | 2T | 5B | 7 | 10 |
| 3 | 2T | 5B | 7 | 10 |
| 4 | 2T | 5B | 7 | 10 |

While the present invention has been described with respect to particular embodiments thereof, it is apparent that numerous other forms and modifications of the invention will be obvious to those skilled in the art. The appended claims in this invention generally should be construed to cover all such obvious forms and modifications which are within the true scope and spirit of the present invention.

We claim:

1. A method of imparting color to a dried-in-place non-chromate conversion coating formed on an aluminum or an aluminum alloy surface through contact with the conversion coating treatment solution comprising adding a phthalo green pigment to said conversion coating treatment solution prior to said contact thereby making the conversion coating visible but not so strong as to bleed through a subsequently applied coating.

2. The method of claim 1 further including adding a nonionic surfactant to said conversion coating treatment solution prior to contact.

3. The method of claim 2 wherein the ratio of pigment to surfactant is about 1 to 1.

4. The method of claim 1 wherein the concentration of the pigment in said conversion coating treatment solution is from about 0.1 to about 1.0%.

* * * * *